United States Patent [19]

Miller

[11] 4,097,050

[45] Jun. 27, 1978

[54] BOARD GAME APPARATUS

[76] Inventor: Mason D. Miller, 821 Payson St., La Verne, Calif. 91750

[21] Appl. No.: 797,053

[22] Filed: May 16, 1977

[51] Int. Cl.[2] ..... A63F 3/00

[52] U.S. Cl. ..... 273/243

[58] Field of Search ..... 273/134 AD, 134 D, 134 C, 273/134 E, 134 GM, 134 GB, 134 AC, 131 AB, 131 R, 131 KC, 131 K, 131 BB, 134 A, 134 AE, 134 AB, 134 AA, 134 AF, 134 B, 134 G, 134 GA

[56] References Cited

U.S. PATENT DOCUMENTS

| | | | |
|---|---|---|---|
| 964,644 | 7/1910 | Henry | 273/131 K |
| 1,039,485 | 9/1912 | Biggar | 273/134 GM |
| 1,526,017 | 2/1925 | Searle | 273/131 K |
| 1,638,094 | 8/1927 | Gilmour | 273/134 E |
| 2,223,175 | 11/1940 | Ink | 273/134 AD |

FOREIGN PATENT DOCUMENTS

| | | | |
|---|---|---|---|
| 1,042,543 | 6/1953 | France | 273/134 AD |
| 23,792 of | 1896 | United Kingdom | 273/131 AB |

*Primary Examiner*—Richard C. Pinkham
*Assistant Examiner*—Harry G. Strappello
*Attorney, Agent, or Firm*—Fred N. Schwend

[57] ABSTRACT

A game board is provided with a center area and a plurality of squares surrounding such area and over which playing pieces, one for each player, are advanced as directed by a suitable randomly operable selecting device. Randomly situated ones of the squares form open ended cells having entrances which open in different directions, arranged at random to enable scoring and advancement of the playing pieces about the center area according to prescribed rules.

6 Claims, 4 Drawing Figures

FIG. 1.
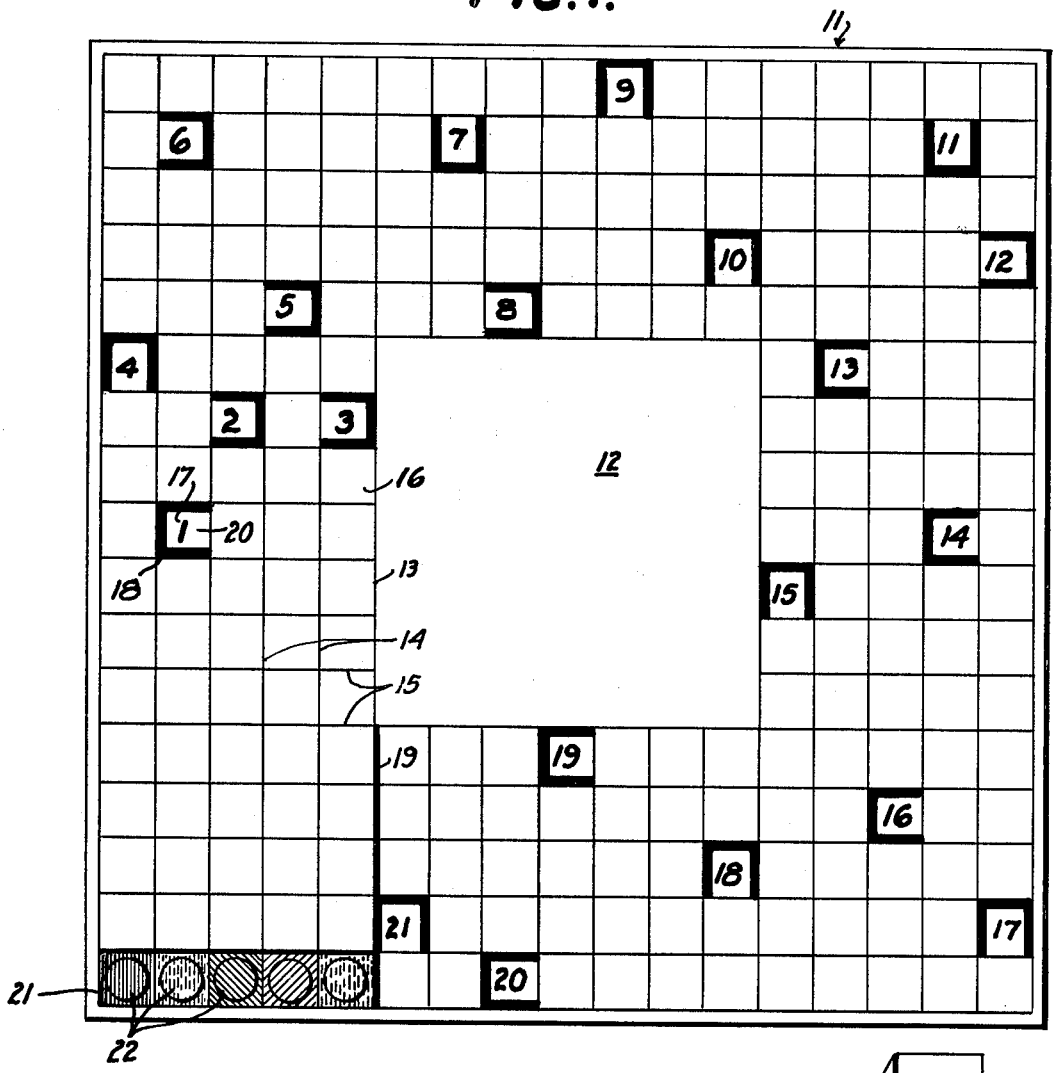
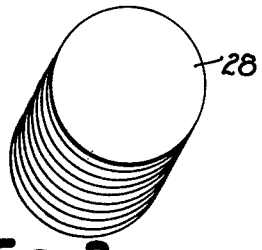
FIG. 2.
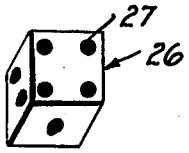
FIG. 3.
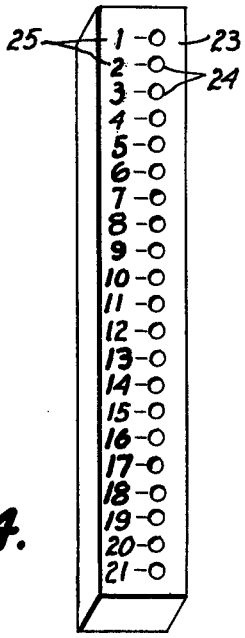
FIG. 4.

BOARD GAME APPARATUS

BACKGROUND OF THE INVENTION

1. Field of the Invention

This invention relates to games and has particular reference to games played on a game board having a plurality of spaces over which playing pieces are advanced.

2. Description of the Prior Art

Many games of the above type have been developed over the years, of which checkers and chess are outstanding examples. However, such games generally require a large number of playing pieces which are advanced from one end of the board to the other and are played according to fairly complicated sets of rules and require considerable mental agility to properly plan and execute a winning strategy. Accordingly, and particularly because of their slow moving nature, such games are generally not of interest to younger children. Further, since a large number of playing pieces are generally required, these pieces may be easily lost or misplaced and the loss of any one piece may render the game inoperative.

SUMMARY OF THE INVENTION

A principal object of the present invention is to provide a game of the above type which is played with interest by both children and adults.

Another object is to provide a game which can be played by different numbers of players.

Another object is to provide a game having a minimum number of playing pieces.

A further object is to provide a fast moving game of the above type which is easy to understand and yet requires a certain amount of skill.

According to the basic aspect of the invention, a game board is provided having a central area and a field of squares encircling the central area. Certain randomly located squares are progressively numbered and are marked to form cells which are open on one side only. Such cells, however, open in different directions which are arranged at random. Only one playing piece is provided per player and the rules are the same regardless of the number of players. A random number selecting device is provided to indicate the number of squares to be advanced by each player in turn.

The play progresses around the board one or more times giving effectively a long playing field which increases and maintains the interest and excitment of the game, particularly for younger children. Since only one playing piece is required per player, there is less chance of losing or misplacing the pieces, and the game is less expensive to manufacture.

Although the same rules apply regardless of the number of players, the game becomes more difficult as more players become involved.

BRIEF DESCRIPTION OF THE DRAWING

The manner in which the above and other objects of the invention are accomplished will be readily understood on reference to the following specification when read in conjunction with the accompanying drawing, wherein:

FIG. 1 is a plan view of a game board embodying a preferred form of the present invention and shown with playing pieces in starting positions.

FIG. 2 is a perspective view of a stack of chips for keeping track of scores.

FIG. 3 is a perspective view of a die for use in randomly determining the number of squares each player is to advance his playing piece.

FIG. 4 is a perspective view of a register device for keeping track of the highest numbered cell reached by any player during the course of a game.

DESCRIPTION OF THE PREFERRED EMBODIMENT

Referring to the drawing, a playing board 11 is provided which may be made of any suitable material and may be foldable in two or more sections. A square central area 12 is defined by coordinate boundary lines 13. The central area 12 is surrounded by spaced coordinately extending lines 14, 15 defining contiguous squares 16 which are located in columns surrounding the central area 12.

Randomly arranged ones, i.e. 17, of the squares 16 are progressively numbered around the board in a clockwise direction from "1" to "21", and each is marked by heavy lines 18 to form a cell which is open at one side as indicated at 20. Such openings 20 also extend in different randomly arranged directions.

A starting row 21 of squares 16 is located at the lower left hand corner of the board and such squares are differently colored to receive similar differently colored playing pieces 22. The squares of the starting row 21 are located in the columns of squares passing along the left hand side of the central area 12, and the right hand end of the starting row 21 is defined by a heavy finish line 19 which extends to the central area 12 and forms the left hand wall of the highest numbered cell, i.e. "21".

A register device 23 is provided comprising a block of wood or similar material having a row of holes 24 formed therein equal in number to the number of cells on the board 11. Such holes are identified by indicia 25, identifying each hole with a corresponding numbered cell. A marker in the form of a pin, pencil or the like may be inserted into any one of the holes 24 to indicate the highest numbered cell to which any player has advanced as will appear presently.

FIG. 3 illustrates a conventional die cube 26 having different numbers of spots 27 on its various sides, ranging in number from one to six. Such die forms a selection device for randomly selecting the number of squares each playing piece is to be advanced. However, other well known types of random selection devices may be used wherein a value from "1" to "6" may be obtained by chance.

In playing the game, the players select respective playing pieces 22 and locate them on the correspondingly colored starting squares 21. The die 26 is then rolled to indicate the number of squares the player having the first or leftmost playing piece 22 is to advance his piece. The object of each player is to land his playing piece 22 in a cell 17 which can only be entered through its opening 20. The piece 22 can be stepped in any direction, except diagonally, but cannot step on the same square 16 more than once during each advance. The die 26 is then rolled to indicate the number of squares the next player can advance, etc., until one of the players scores by landing his piece exactly in a cell 17. A marker such as a pin, pencil, etc., is then placed in the hole 24 corresponding in number to the numbered cell, i.e. "1", on which the player has landed and the player also receives a chip 28 or the like to represent his score. This procedure is repeated around the board by the players advancing to successively higher numbered cells until one of the players has accumulated a prescribed number of chips, for example 10, which determines that he has won the game. However, when one player has scored on a particular cell 17, no other player can score on that cell or on any lower numbered cell but must advance to another higher numbered cell in order to score.

In the event that no player has accumulated the required number of chips to win the game by the time one player has scored by entering the highest numbered cell 17, i.e. "21", the game continues and as one of the players passes across the finish line 19, he continues to again step through the originally traversed columns of squares, aiming toward the cell number "1" or a higher numbered cell. At this point, the marker is removed from the block 23 and is subsequently placed in the hole corresponding to that cell reached by one of the players. The playing process continues as noted hereinabove until one of the players accumulates the required number of chips 28.

Many other rules may be imposed on the game. For example, a player must go around a cell 17 unless he wishes to enter it. He must also go around any square which is already occupied by the playing piece of a player. Also, when a player's piece is in a cell waiting for a next advance and is blocked by another player's piece lying directly in front of the opening, the first player loses his turn. Further, if a player's piece 22 is in a cell and a second player enters his piece in the same cell, the first player must give up a chip to the second player.

It will be obvious to those skilled in the art that many variations may be made in the exact construction shown without departing from the spirit of this invention.

I claim:

1. A game comprising playing pieces for respective ones of different players, a playing board having a central area, a plurality of contiguous squares on said board surrounding said central area, certain of said squares comprising starting positions for respective ones of said playing pieces, certain of said squares being progressively numbered, said numbered squares being marked to form cells, each of said cells having an entrance on one side only, a selection device for randomly selecting the number of squares said playing pieces are to be advanced in turn from said starting positions around said central area, a registering device for indicating throughout the game the highest numbered cell to which any player has advanced, said registering device having a plurality of registering elements, and indicia identifying said registering elements with corresponding ones of said numbered squares.

2. A game as defined in claim 1 wherein said numbered squares are randomly located about said central area.

3. A game as defined in claim 2 wherein said entrances of said cells extend randomly in different directions.

4. A game as defined in claim 3 wherein said starting positions comprise a starting row of said squares located in advance of the lowest numbered one of said numbered squares.

5. A game as defined in claim 4 wherein said squares of said starting row are differently colored and said playing pieces are colored corresponding to respective ones of said colored squares.

6. A game as defined in claim 4 comprising means for adding to a score for each player each time his playing piece moves to a numbered square not previously entered by the playing piece of another player, and means forming a finish line extending outwardly from said central area and along the highest numbered one of said numbered squares, said finish line upon being crossed by a first one of said playing pieces denoting the restart of advancement of said playing pieces around said central area.

* * * * *